United States Patent [19]

Martinez

[11] 4,324,345

[45] Apr. 13, 1982

[54] DISPENSER FOR AUTOMATICALLY DISPENSING PERMANENT WAVE TISSUE SHEETS

[76] Inventor: Manuel M. Martinez, 2105 Park Ave., San Jose, Calif. 95126

[21] Appl. No.: 128,163

[22] Filed: Mar. 7, 1980

[51] Int. Cl.[3] ..... B65H 3/06

[52] U.S. Cl. ..... 221/41; 221/43; 221/210; 221/259; 221/244; 271/33

[58] Field of Search ..... 221/210, 259, 42, 43, 221/41, 244; 271/33; 225/27, 28; 132/79 D; 312/59, 50, 60, 61

[56] References Cited

U.S. PATENT DOCUMENTS

| | | | |
|---|---|---|---|
| 592,811 | 11/1897 | Moehn | 221/259 X |
| 847,688 | 3/1907 | Plummer | 221/259 X |
| 1,088,142 | 2/1914 | Gardner | 221/259 X |
| 1,190,661 | 7/1916 | Marker | 221/43 X |
| 1,276,493 | 8/1918 | Cooke | 221/259 X |
| 3,094,323 | 6/1963 | Catania | 271/33 |
| 3,204,817 | 9/1965 | Kostering | 221/210 |
| 3,248,006 | 4/1966 | Lowery et al. | 221/259 X |

FOREIGN PATENT DOCUMENTS

| | | | |
|---|---|---|---|
| 17339 | 9/1956 | Fed. Rep. of Germany | 221/259 |

*Primary Examiner*—Allen N. Knowles

[57] ABSTRACT

This invention relates to dispensers, primarily the dispensing of permanent wave tissue sheets and other flexible sheet members.

It is the object of this invention to provide an improved and simple automatic sheet dispenser capable of dispensing individual flat sheets from a stack. The principal advavtageous feature of the invention is the unique automatic combination driving roll and sheet stop construction.

12 Claims, 5 Drawing Figures

DISPENSER FOR AUTOMATICALLY DISPENSING PERMANENT WAVE TISSUE SHEETS

BACKGROUND OF THE INVENTION

1. Field of Invention

This instant invention relates to sheet dispensing mechanisms, mainly for dispensing individual peramanent wave tissue sheets from a stack.

2. Description of prior art

Dispensers in the past do not offer the practicability and simplicity of design required to dispense said tissue sheets. Known dispensers entail complicated stacking requirements and do not provide a means to determine the amount of the contents therein. Past inventions in this catagorie offer complex moving parts and enclosures which are not economical for common dispensing tasks such as suggested in U.S. Pat. No. 3,117,694, which illustrates a reverse roll discharge action through a restricted throat passage. A somewhat similar invention is U.S. Pat. No. 1,357,070 in which a spring support urges the stack toward the serving roll. Yet another example is suggested in U.S. Pat. No. 1,466,492, where the single weight of the stack provides friction to the roll.

At present a known method that is used commercially for the dispensing of permanent wave tissue sheets, largely resembles U.S. Pat. No. 4,181,240, whereas said tissue sheets are removed from the original manufacturer's box by means of an adhesive tab attached to the same container. This approach is awkward in producing the sheets for grasping by the user.

Thus prior dispenser art does not offer the hairdresser in the professional field of cosmetology an apparatus suitable for dispensing of said permanent wave tissue sheets. This is a requirement needed during the service of administering a cold or heat permanent wave application on the clients hair.

OBJECTS OF THE INVENTION

The primary object of this invention is to provide a device for automatically dispensing permanent wave tissue sheets in a singular fashion.

An object of the recent invention is to provide a container that will accomodate a multiplicity of sheet stack sizes.

Another object of the present invention is to provide a dispenser, simple in structure and easy to operate.

Yet another object of the present invention is to provide a trouble free apparatus consisting of a few moving parts.

It is a further object of this invention to provide easy loading of tissue stacks.

Still a further object of this invention is to provide a visual means of showing the amount of contents therein.

SUMMARY OF INVENTION

This invention for the first time makes practicable automatic forward dispensing of sheets in the original charge stack position and offers distinct advantages over those dispensers and methods now generally employed. It is easily adaptable for commercial or domestic use.

Briefly, this unique apparatus involves the utilization of a single driving roll acting as the sheet serving member with adhesive on its periphery which is in contact with said sheet stack provided in a rectangular container.

The invention delivers a premeasured combination weight press of the driving roll and sheet stop which automatically adjust vertically on cutouts located on the two side walls of said container.

A serving port defined about the periphery of the driving roll between the forward container wall and the sheet stop provides an exit for the sheets, said forward wall constraining the movement of the stack allowing only the top most sheet to dispense forward. As one sheet is withdrawn manually another is automatically attached to the adhesive paper and brought into position available for withdrawal, thus obtaining the unique automatic operation, with said sheet stop preventing excessive rotation of the dispensed sheet.

The invention will be more fully understood with reference to the following detailed description of a specific embodiment taken in conjunction with the drawings.

DESCRIPTION OF THE DRAWINGS

Figure 1:
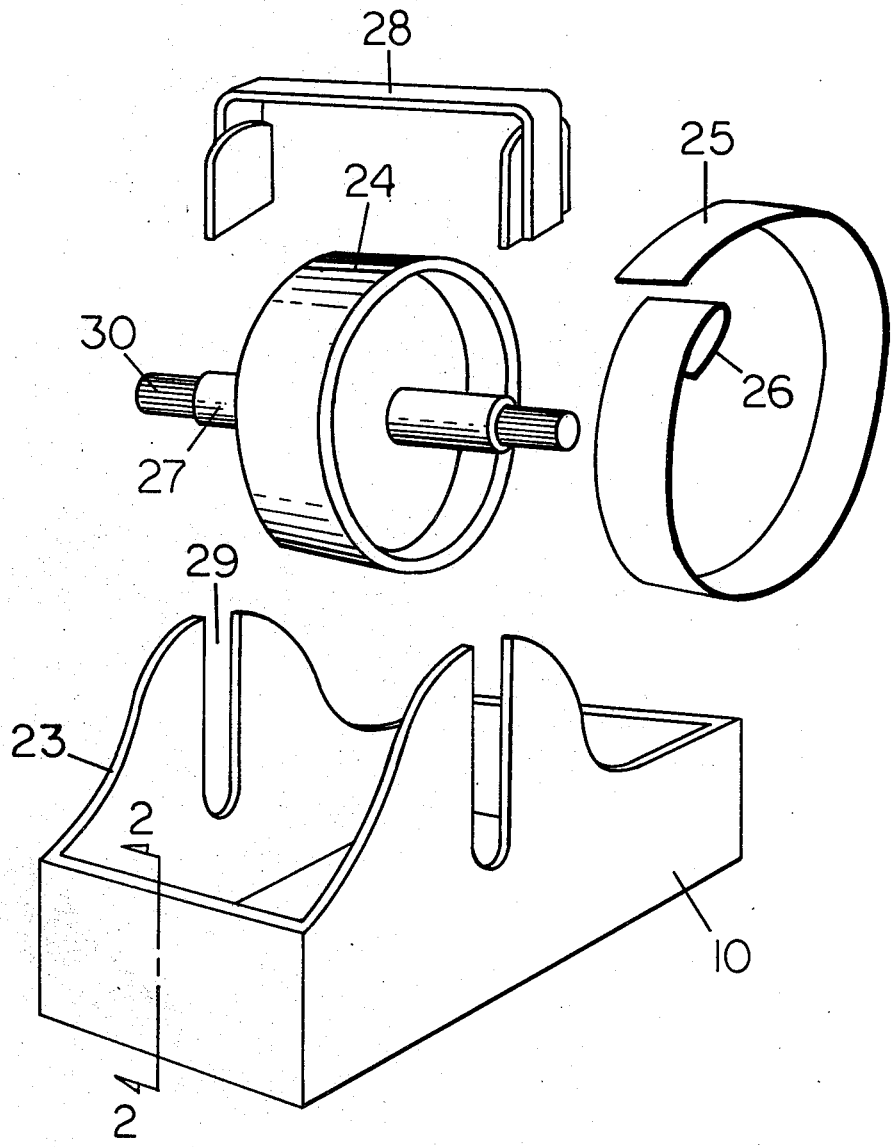
FIG. 1 is an exploded view of a preferred embodiment of this invention.
Figure 2:
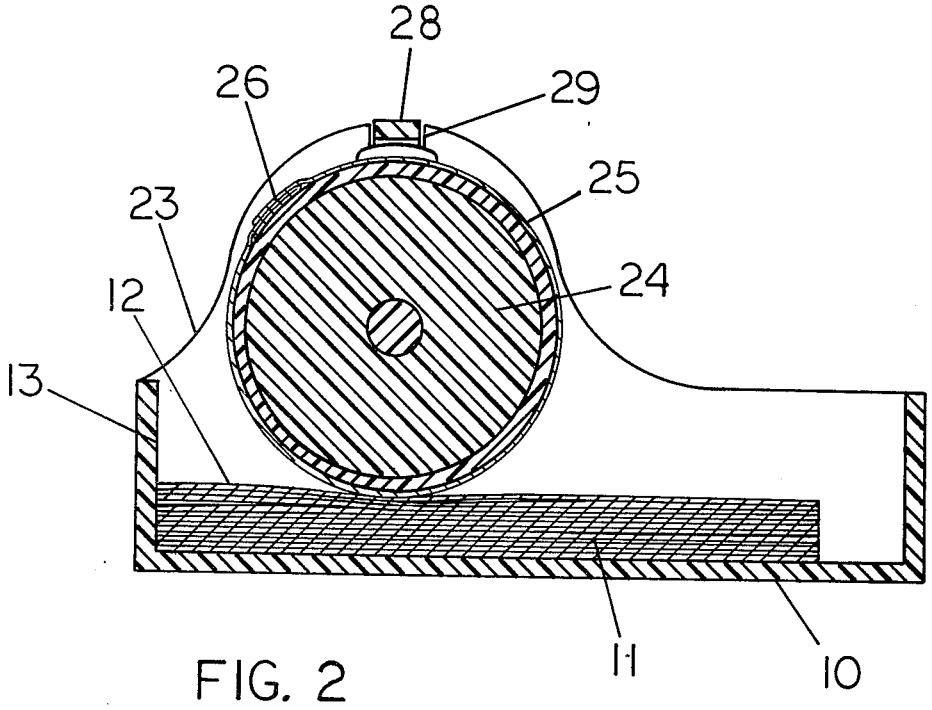
FIG. 2 is a center section of the complete embodiment of FIG. 1, taken on line 2—2.
Figure 3:
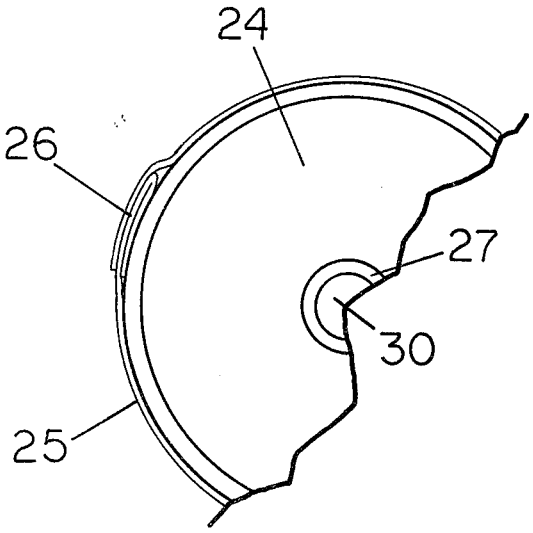
FIG. 3 represents an enlarged cutaway portion of the driving roll to illustrate the adhesive paper attached to the periphery of the roll in a non-slip grip application.

Referring to FIG. 1–5, sheet dispensing container 10 is provided to be mounted on flat table tops and the like, said container 10 adapted to receive and support a stack of sheets 11 with the face of said stack directed towards the forward container wall 13. A press provided by means of a premeasured weight on the sheet stack, comprised of a sheet stop 28, a driving roll 24 with an adhesive paper 25 around the periphery of said roll and said sheet stop 28 centered above the driving roll 24 with adhesive engaging sheet stack 11, said roll being rotatably mounted to pivot on cutouts 29, said cutouts providing an automatic vertical adjustable press on sheet stack 11. Located between forward container wall 13 and sheet stop 28 and about the periphery of driving roll 24 is described a serving part 23. Driving roll 24 is in contact with stack face 12 and is adapted to execute sliding movement of individual sheets from above there through and directs sheets forward into serving part 23 with adequate clearance.

A turning knob 30, mounted on both ends of shaft 27 is provided for the purpose of initially setting the dispenser to present the first sheet to the user. Thereafter said knob not touched by the user in obtaining subsequent sheets from the dispenser.

In this embodiment the driving roll is of considerable arcuate length, which in itself ensures substantial friction contact between the sheets being drawn through serving port 23. Resistance to slippage of the sheet stack is provided by the forward container wall 13, against which the sheet stack forward edge is urged. Overcoming this resistance by pulling the foremost sheet applies torque to serving roll 24 and automatically friction action serves the next sheet.

Figure 4:
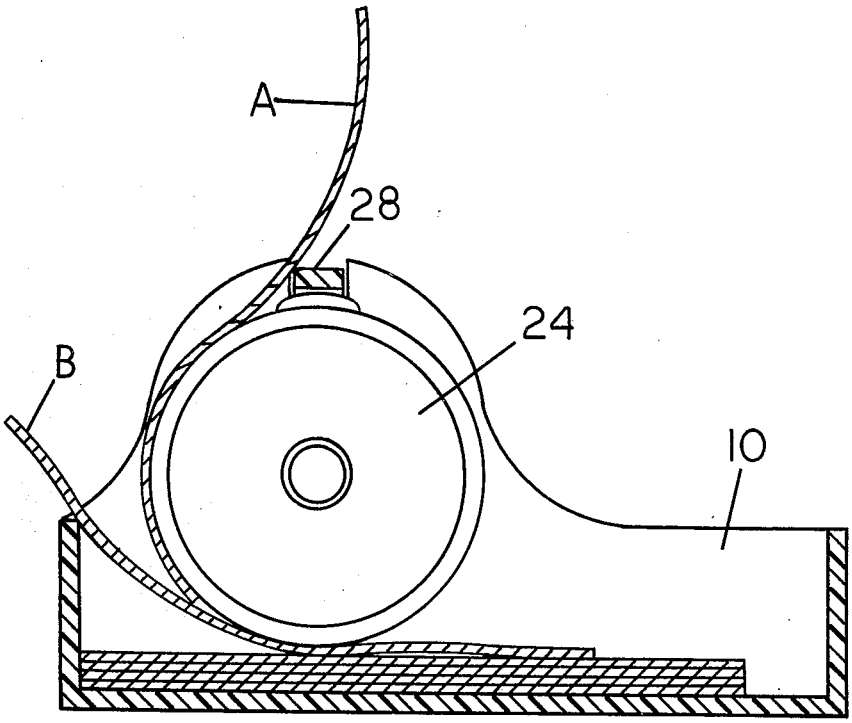
FIG. 4 is a partial section similar to FIG. 2, showing successive position of sheets dispensed and illustrative of the automatic feature and purpose of the sheet stop, sheet thickness being somewhat exaggerated for better viewing.
Figure 5:
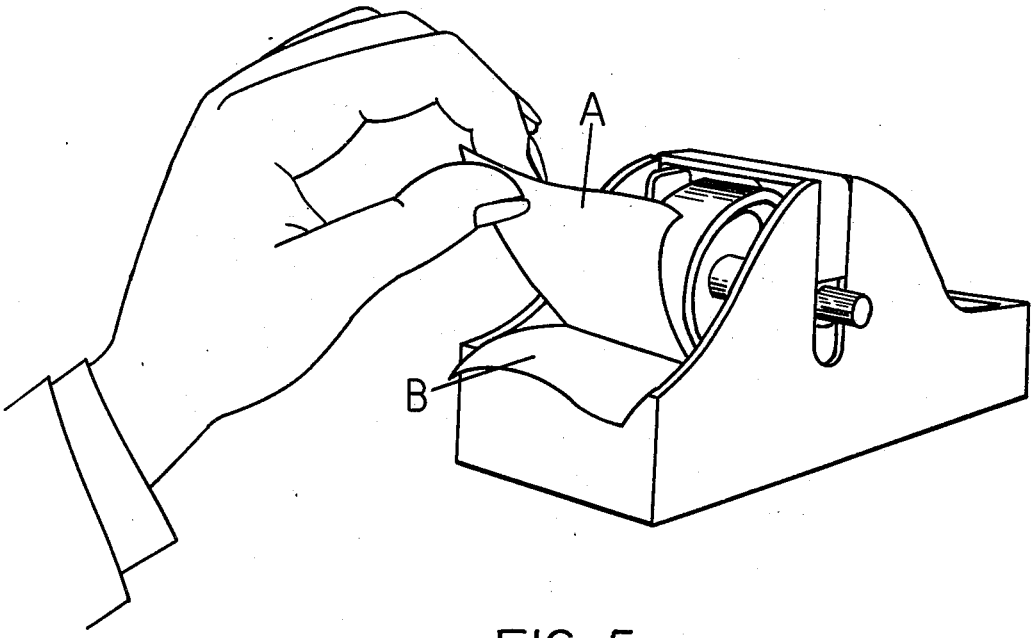
FIG. 5 is a perspective view of the dispenser showing the grasping operation of tissue withdrawal and indicating approximate size of the present invention.

The foremost face sheet is designated A, the next sheet B, as illustrated in FIG. 4 and FIG. 5.

Operation of the apparatus is as follows: The stack of flat sheets is inserted into the container which is open at the top after removal of sheet stop 28 and serving roll 24. The stack is placed against the forward container wall 13, the driving roll 24 engaging sheet A with substantial pressure and providing positive drive contact with friction from adhesive paper 25 which is attached on the periphery of said driving roll in a non-slip grip application 26. Knob 30 is turned by the user and the portions of sheet A in contact with the driving roll moves therewith. The upper portion of sheet A corresponding with the outer perimiter of the driving roll 24, adhering to adhesive paper 25 and sheet A immediately begins to form at the entry and through serving port 23. As the driving roll continues to turn, further portions of the succeeding sheet are brought forward and into the sheet exit. The forward edge of sheet A is exposed for removal and is carried with said driving roll in an arcuate path, FIGS. 4 and 5.

The knob is turned until a sufficient part of sheet A appears in the serving port region for grasping, FIG. 5. When sheet A is grasped and pulled for removal, the friction and press of driving roll 24 applies torque upon pulling on sheet A. Thus said driving roll moves with manual pull upon sheet A, exposing sheet B to the adhesive on driving roll 24, automatically presenting sheet B and subsequent sheets for removal in a continuous operation and sheet stop 28 limits excessive rotation of the dispensed sheets, FIG. 4.

After complete removal of sheet A, sheet B is ready for removal, thus pulling and removal of sheet B will automatically serve the next sheet and so on.

The proportions of the apparatus may be widely varied but adequate roll adhesive friction contact must be assured for permanenet wave tissue sheets and the like. Driving roll 24 may be of a diameter of about two and one quarter inches plus a minimum width of one inch for substantial exposure of the adhesive area portion 25. The distance length between the forward container wall 13 and the outside diameter of the driving roll 24 may be a distance of about one half inch to provide for adequate arcuate surface and a wide open area at serving port 23 for comfortable grasping and deployment of the sheets.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

What I claim is a dispenser for automatically dispensing permanent wave tissue sheets which comprises:

1. A rectangular container, open at the top and adapted to hold a stack of flat tissue sheets, each edge aligned with a pair of parallel edges, said container having four vertical walls, forward and aft walls identifying the long rectangular portion and determining the stack depth of said container with the two side walls providing vertical cutouts, A single adhesive friction driving roll with its shaft guided on said cutouts positioned parallel to said sheet stack, A sheet stop with legs thereof guided on said cutouts mounted parallel above said driving roll, An adhesive paper attached to the periphery of said driving roll, A knob connected on said driving roll shaft ends, A serving port located between the forward wall and sheet stop, Said driving roll and sheet stop further comprising a pre-measured weight press.

2. A dispenser according to claim 1, wherein said container will accomodate a multiplicity of sheet stack sizes.

3. A dispenser according to claim 1, wherein said cutouts are located approximately one and one half inches aft from the forward wall of said container.

4. A dispenser according to claim 3, wherein said cutouts provide for manual removal of the sheet stop and driving roll.

5. A dispenser according to claim 4, wherein said driving roll and sheet stop automatically adjust vertically on said cutouts.

6. A dispenser according to claim 1, wherein said driving roll and sheet stop comprise a minimum premeasured press weight of approximately forty grams.

7. A dispenser according to claim 1, wherein said driving roll is approximately two and one quarter inches in diameter.

8. A dispenser according to claim 1, wherein a one side adhesive paper is attached to the periphery of said driving roll in a non-slip grip application.

9. A dispenser according to claim 1, wherein the serving port is of a substantial arcuate length, exposing approximately one third of the driving roll periphery.

10. A dispenser according to claim 9, wherein the serving port area provides a concave portion on the two side vertical walls of said container.

11. A dispenser according to claim 1, wherein said container requires a sheet stack depth of approximately one inch.

12. A dispenser according to claim 11, wherein said container is open at the top whereby the contents therein are visible.

* * * * *